US012660952B2

(12) United States Patent
Dicus

(10) Patent No.: US 12,660,952 B2
(45) Date of Patent: Jun. 23, 2026

(54) WINE GLASS COVER DEVICE

(71) Applicant: Brett Dicus, Boonville, MO (US)

(72) Inventor: Brett Dicus, Boonville, MO (US)

( * ) Notice: Subject to any disclaimer, the term of this patent is extended or adjusted under 35 U.S.C. 154(b) by 0 days.

(21) Appl. No.: 18/825,693

(22) Filed: Sep. 5, 2024

(65) Prior Publication Data

US 2026/0060458 A1 Mar. 5, 2026

(51) Int. Cl.
*A47G 19/22* (2006.01)
*B65D 43/02* (2006.01)

(52) U.S. Cl.
CPC ..... *A47G 19/2205* (2013.01); *B65D 43/02* (2013.01); *B65D 2543/00046* (2013.01)

(58) Field of Classification Search
CPC ..... A47G 19/2205; A47G 19/2272; A47G 19/22; A47G 19/2211; A47G 19/2222; A47G 19/2227; A47G 23/0233; B65D 43/02; B65D 2543/00046; B65D 2543/00092; B65D 2543/00537; B65D 2543/00851; B65D 2543/00027; B65D 43/0222
USPC ..... 220/740, 739, 263; 215/396
See application file for complete search history.

(56) References Cited

U.S. PATENT DOCUMENTS

| | | | | |
|---|---|---|---|---|
| 3,107,029 | A * | 10/1963 | Rylander | A47G 23/0266 215/396 |
| 4,872,577 | A * | 10/1989 | Smith | B65D 51/04 220/264 |
| 5,102,002 | A * | 4/1992 | Whitley | A47G 19/2205 220/823 |
| D663,574 | S | 7/2012 | Shenkel | |
| 8,579,138 | B2 | 11/2013 | Jamison | |
| 9,038,850 | B1 * | 5/2015 | Wilson | A47G 19/2205 220/758 |
| 10,022,004 | B2 | 7/2018 | Taoirmina | |
| 10,494,156 | B2 | 12/2019 | Alvarez | |
| 2011/0233226 | A1 | 9/2011 | Muxo | |
| 2015/0166235 | A1 | 6/2015 | Harding | |

FOREIGN PATENT DOCUMENTS

| | | |
|---|---|---|
| GB | 2420556 | 5/2006 |

* cited by examiner

*Primary Examiner* — King M Chu

(57) ABSTRACT

A wine glass cover device for automatically opening and closing a wine glass includes a sleeve comprised of a resiliently stretchable material thereby enabling the sleeve to be positioned around the wine glass. A lid is pivotally disposed on the sleeve and the lid is biased into a closed position to inhibit insects from entering the wine glass. The lid is urgeable into an open position to enable the user to drink from the wine glass. An opening mechanism is movably attached to the sleeve and is in mechanical communication with the lid. The lid is urged into the open position when the trigger is depressed to enable to the user to drink from the wine glass. The opening mechanism biases the lid into the closed position when the trigger is not depressed.

6 Claims, 6 Drawing Sheets

WINE GLASS COVER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wine glass devices and more particularly pertains to a new wine glass device for automatically opening and closing a wine glass. The device includes a sleeve that is positionable around a wine glass and a lid which is pivotally disposed on the sleeve which is oriented to cover the wine glass. The device includes an opening mechanism movably attached to the sleeve which pivots the lid between an open position and a closed position. The opening mechanism includes a trigger that a user will depress to urge the lid into the open position to drink from the wine glass. The opening mechanism biases the lid into the closed position when the trigger is released to inhibit insects from entering the wine glass.

(2) Description of Related Art Including Information Disclosed Under 37 CFR 1.97 and 1.98

The prior art relates to wine glass devices including: a variety of beverage container lid devices that each at least includes a means of attaching to a beverage container and a lid pivotally attached to the means of attaching for closing the beverage container and a trigger attached to the lid for opening the lid; a variety of beverage container lid devices that each at least includes a planar lid that is manually positionable over a wine glass to close the wine glass and in some cases the planar lid is foraminous. In no instance does the prior art disclose a wine glass cover device that includes a sleeve that is positionable around a wine glass and a lid which is pivotally attached to the sleeve which closes the wine glass and an opening mechanism movably attached to the sleeve which includes a trigger that can be depressed by the user to pivot the lid into an open position to drink from the wine glass.

BRIEF SUMMARY OF THE INVENTION

An embodiment of the disclosure meets the needs presented above by generally comprising a sleeve comprised of a resiliently stretchable material thereby enabling the sleeve to be positioned around the wine glass. A lid is pivotally disposed on the sleeve and the lid is biased into a closed position to inhibit insects from entering the wine glass. The lid is urgeable into an open position to enable the user to drink from the wine glass. An opening mechanism is movably attached to the sleeve and is in mechanical communication with the lid. The lid is urged into the open position when the trigger is depressed to enable to the user to drink from the wine glass. The opening mechanism biases the lid into the closed position when the trigger is not depressed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
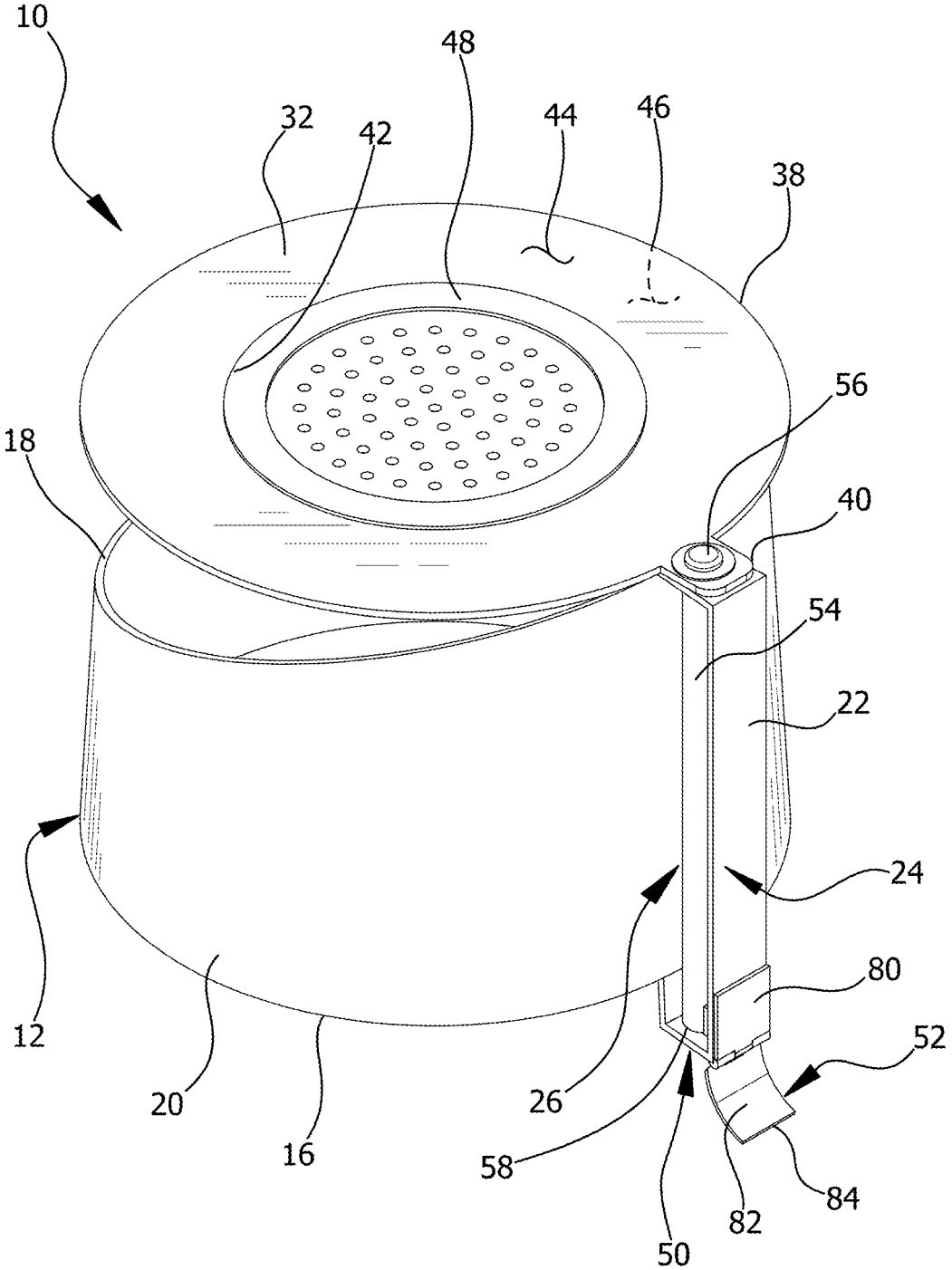
FIG. 1 is a top perspective view of a wine glass cover device according to an embodiment of the disclosure.
Figure 2:
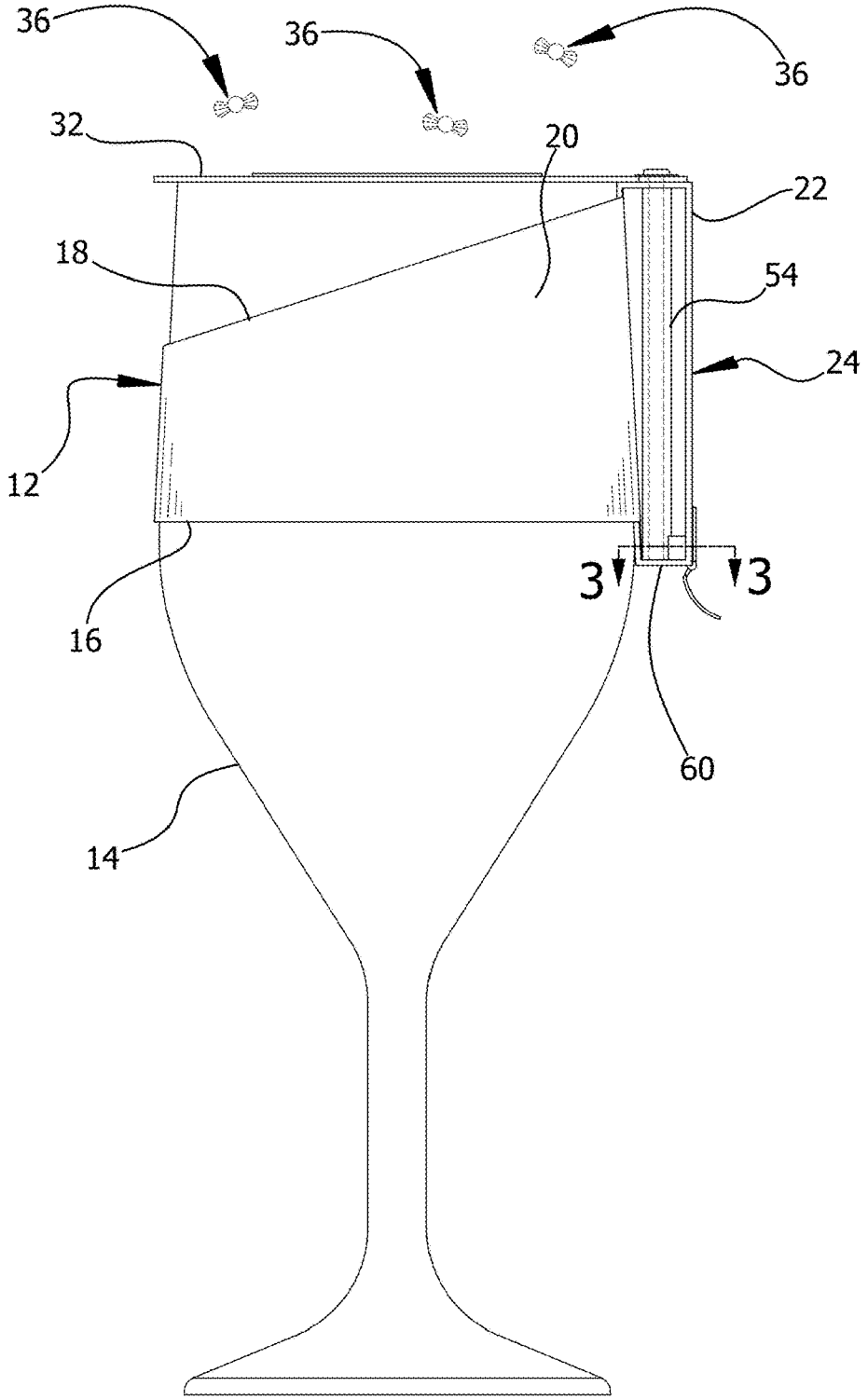
FIG. 2 is a left side view of an embodiment of the disclosure showing a lid in a closed position.
Figure 3:
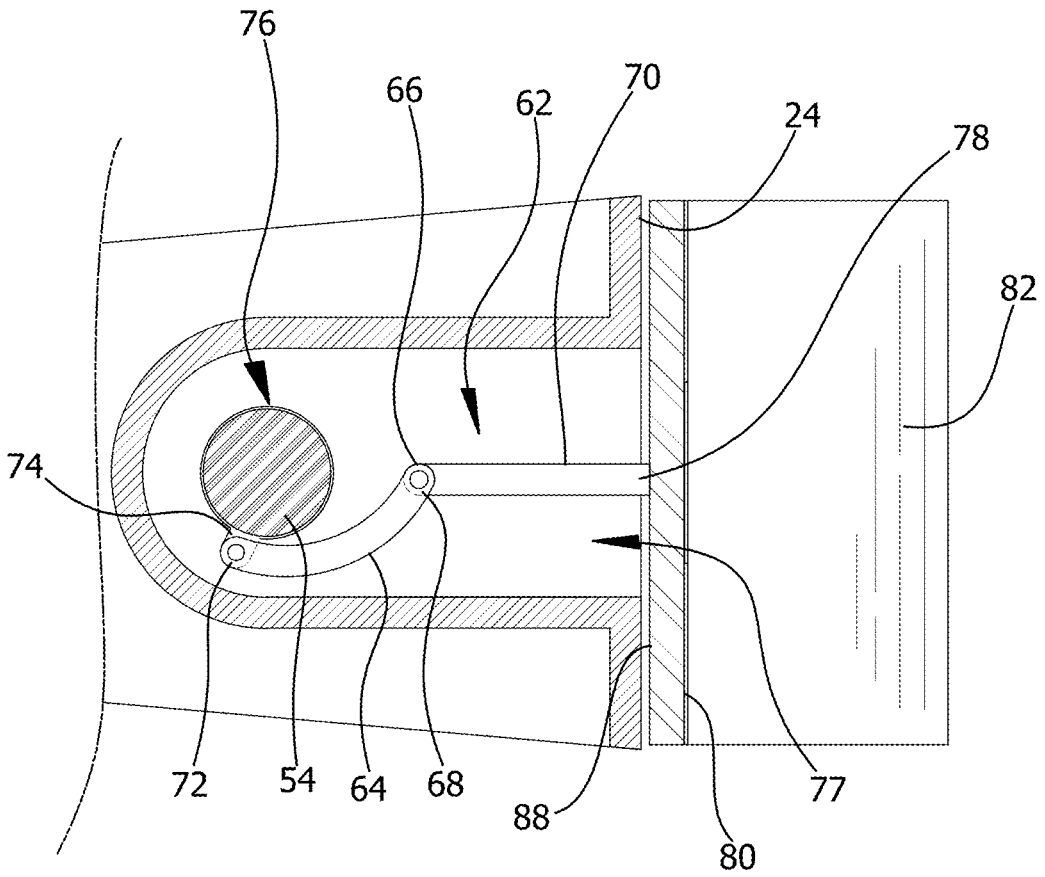
FIG. 3 is a cross sectional view taken along line 3-3 of FIG. 2 of an embodiment of the disclosure.
Figure 4:
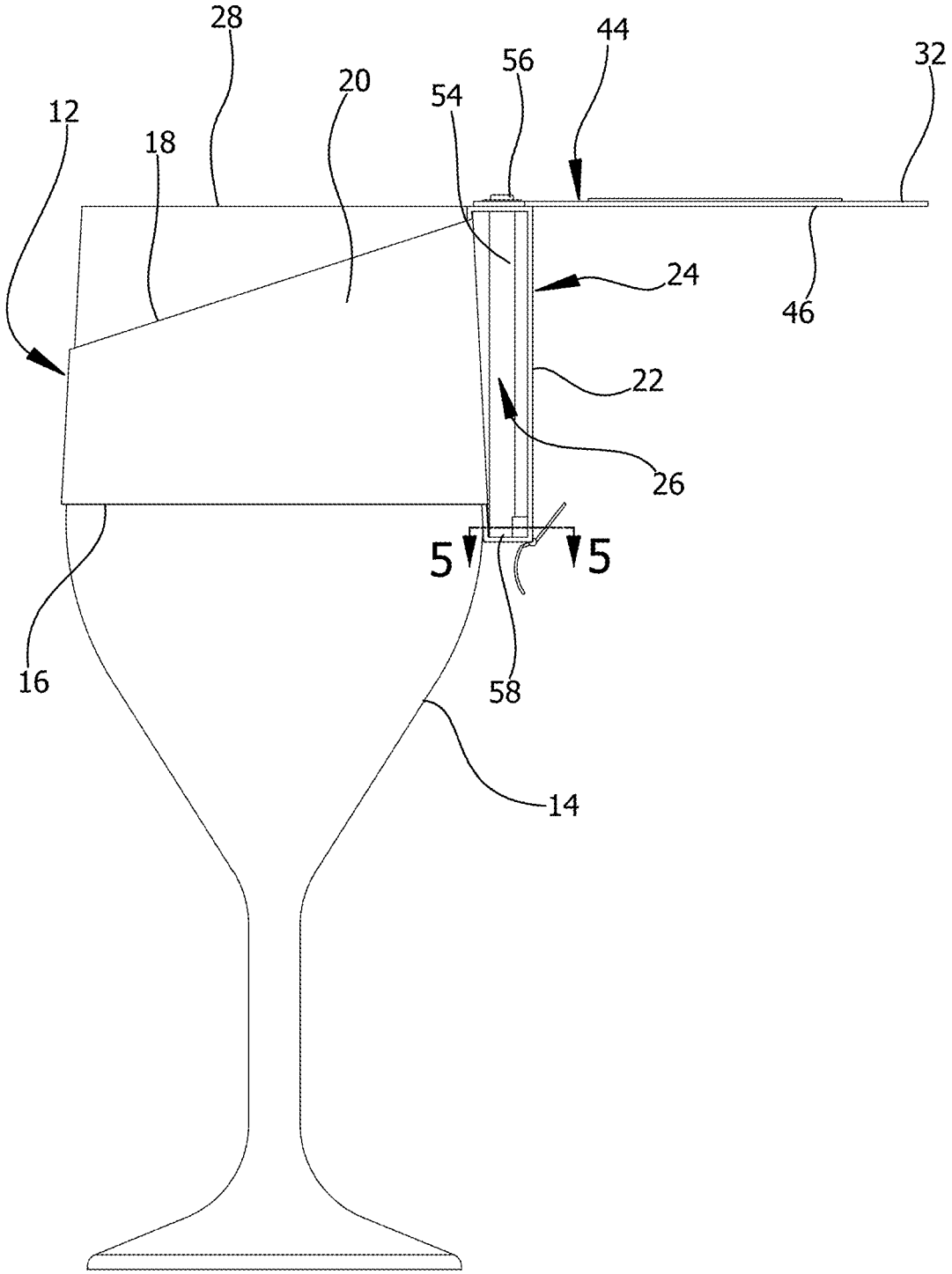
FIG. 4 is a left side view of an embodiment of the disclosure showing a lid in an open position.
Figure 5:
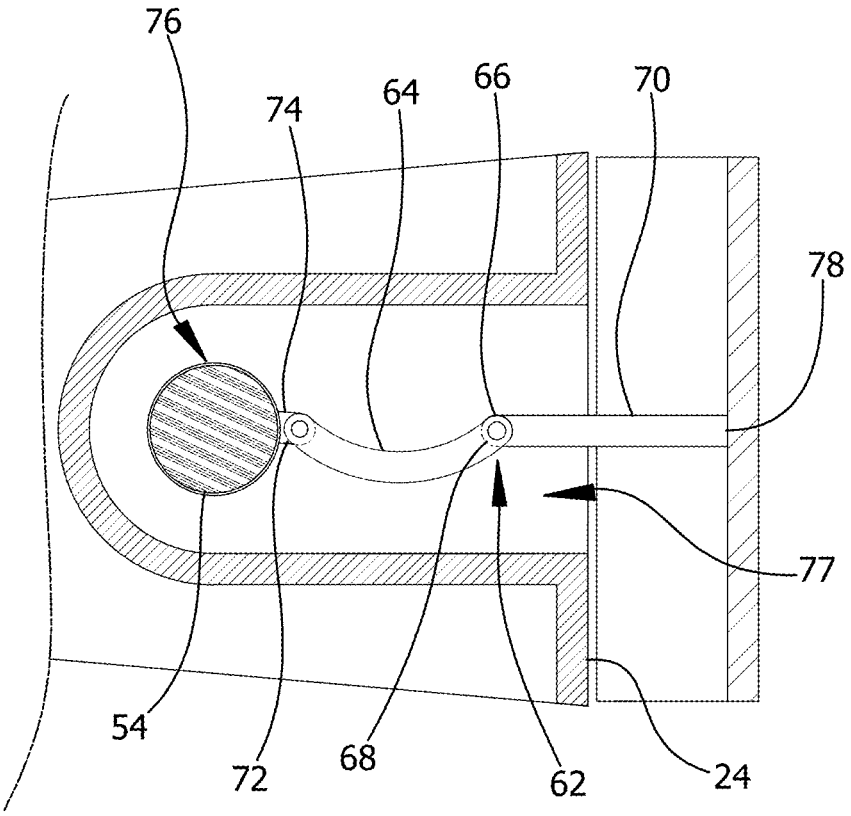
FIG. 5 is a cross sectional view taken along line 5-5 of FIG. 4 of an embodiment of the disclosure.
Figure 6:
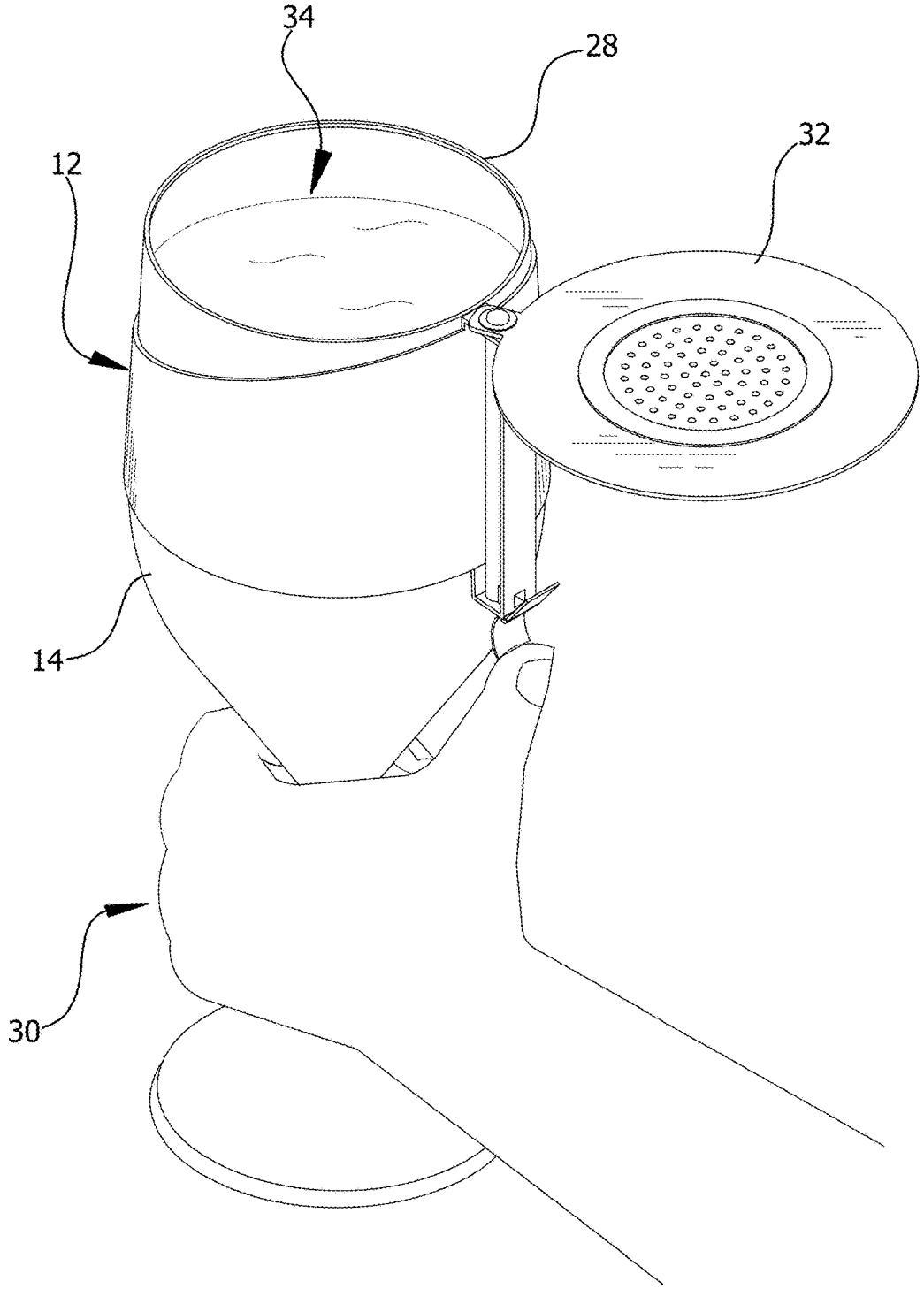
FIG. 6 is a perspective in-use view of an embodiment of the disclosure.

With reference now to the drawings, and in particular to FIGS. 1 through 6 thereof, a new wine glass device embodying the principles and concepts of an embodiment of the disclosure and generally designated by the reference numeral 10 will be described.

As best illustrated in FIGS. 1 through 6, the wine glass cover device 10 generally comprises a sleeve 12 which is comprised of a resiliently stretchable material, including but not being limited to rubber or silicone. In this way the sleeve 12 can be positioned around a wine glass 14 of varying sizes thereby enabling the sleeve 12 to compress against the wine glass 14 for retaining the sleeve 12 around the wine glass 14.

The wine glass 14 may be a wine glass of any conventional size and design that is commonly associated with drinking either red wines or white wines. The sleeve 12 has a bottom edge 16 and a top edge 18 and an outer wall 20 extending between the top edge 18 and the bottom edge 16. The sleeve 12 has a channel 22 which is integrated into the outer wall 20 and the channel 22 extends from the top edge 18 to a point located below the bottom edge 16. Additionally, the channel 22 has a rear facing wall 24 which is spaced from the outer wall 20 of the sleeve 12 to define a space 26 in the channel 22.

The top edge 18 of the sleeve 12 is oriented to lie on a plane which angles downwardly toward the bottom edge 16 of the sleeve 12 between an intersection with the channel 22 and an opposite side of the top edge 18 with respect to the channel 22. In this way the top edge 18 of the sleeve 12 is spaced downwardly from an upper edge 28 of the wine glass 14 to enable a user 30 to drink from the wine glass 14 without touching their lips to the sleeve 12.

A lid 32 is provided and the lid 32 is pivotally disposed on the sleeve 12. The lid 32 is biased into a closed position having the lid 32 being positioned over the sleeve 12 thereby enabling the lid 32 to cover an opening 34 into the wine glass 14 when the sleeve 12 is positioned around the wine glass 14. In this way the lid 32 inhibits insects 36 from entering the opening 34 into the wine glass 14 while the user 30 is not drinking from the wine glass 14. Conversely, the lid 32 is urgeable into an open position having the lid 32 being displaced laterally from the sleeve 12. In this way the lid 32 exposes the opening 34 into the wine glass 14 thereby enabling the user 30 to drink from the wine glass 14.

The lid 32 has a perimeter edge 38 which is continuously arcuate about a center of the lid 32 such that the lid 32 has a disk shape. The lid 32 has a tab 40 extending laterally away from the perimeter edge 38 and the tab 40 is positioned over the channel 22 on the outer wall 20 of the sleeve 12. The lid 32 has a hole 42 extending through a top surface 44 and a bottom surface 46 of the lid 32 to pass air through the lid 32 thereby enabling air to circulate in the wine glass 14 when the lid 32 is in the closed position. The hole 42 is centrally located on the lid 32 and a strainer 48 is disposed on the lid 32 having the strainer 48 covering the hole 42 in the lid 32. In this way the strainer 48 inhibits insects 36 from passing through the hole 42. Furthermore, the strainer 48 is foraminous to enable air to pass through the strainer 48.

An opening mechanism 50 is provided and the opening mechanism 50 is movably attached to the sleeve 12. The opening mechanism 50 has a trigger 52 which can be manipulated by the user 30 and the opening mechanism 50 is in mechanical communication with the lid 32. The lid 32 is urged into the open position when the trigger 52 is depressed to enable to the user 30 to urge the lid 32 into the open position to drink from the wine glass 14. The opening mechanism 50 biases the lid 32 into the closed position when the trigger 52 is not depressed to automatically position the lid 32 in the closed position for the user 30 when the user 30 releases the trigger 52.

The opening mechanism 50 includes a shaft 54 which is located in the space 26 in the channel 22. A top end 56 of the shaft 54 is affixed to the tab 40 on the perimeter edge 38 of the lid 32 and a bottom end 58 of the shaft 54 is rotatably attached to a bottom wall 60 of the channel 22. The shaft 54 is biased to rotate in a first direction thereby enabling the lid 32 to be positioned over the top edge 18 of the sleeve 12. Conversely, the shaft 54 is rotatable in a second position having the lid 32 being displaced from the top edge 18 of the sleeve 12. The opening mechanism 50 includes a linkage 62 which comprises a first arm 64 having a first end 66 being pivotally coupled to a coupled end 68 of a second arm 70. The first arm 64 has a second end 72 which is pivotally attached to a connection point 74 on an outside surface 76 of the shaft 54 and the connection point 74 is located adjacent to the bottom end 58 of the shaft 54.

The second arm 70 can be extended outwardly through an opening 77 in the rear facing wall 24 of the channel 22. The first arm 64 is curved between the first end 66 of the first arm 64 and the fixed end of the first arm 64. The connection point 74 is rotated toward the outer wall 20 of the sleeve 12 when the shaft 54 is biased to rotate in the first direction having the first arm 64 curving around the shaft 54 and having a distal end 78 of the second arm 70 being aligned with the rear facing wall 24 of the channel 22. Conversely, the connection point 74 is directed toward the rear facing wall 24 of the channel 22 when the shaft 54 is rotated in the second direction having the first arm 64 extending toward the rear facing wall 24 of the channel 22 and having the second arm 70 extending outwardly through the opening 77 in the rear facing wall 24 of the channel 22.

The trigger 52 comprises a first panel 80 which is oriented at an angle with a second panel 82. An intersection between the first panel 80 and the second panel 82 is hingedly attached to the rear facing wall 24 of the channel 22 at an intersection with the bottom wall 60 of the channel 22. Furthermore, the second panel 82 is curved between an intersection with the first panel 80 and a lower edge 84 of the second panel 82 to accommodate the user's finger 86. The distal end 78 of the second arm 70 of the linkage 62 is pivotally attached to a front surface 88 of the first panel 80. The first panel 80 rests against the rear facing wall 24 of the channel 22 when the shaft 54 is biased to rotate in the first direction. Conversely, the first panel 80 angles rearwardly from the rear facing wall 24 of the channel 22 when the second panel 82 is depressed thereby enabling the linkage 62 to rotate the shaft 54 in the second direction.

In use, the sleeve 12 is positioned around the wine glass 14 to enable the lid 32 to be closely aligned with the opening 34 into the wine glass 14. In this way the lid 32 covers the opening 34 into the wine glass 14 to inhibit insects 36 or other debris from entering the wine glass 14. The user 30 depresses the trigger 52 to enable the lid 32 to be pivoted into the open position to expose the opening 34 into the wine glass 14. In this way the user 30 can drink from the wine glass 14 while the user 30 is holding the trigger 52. The lid 32 is biased into the closed position when the user 30 releases the trigger 52 to automatically cover the opening 34 into the wine glass 14. Additionally, the sleeve 12 is removable from the wine glass 14 at any time and for any reason and can subsequently be repositioned around the wine glass 14 any number of times.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wine glass cover device for opening or closing a wine glass to either inhibit insects from entering the wine glass or to enable a user to drink from the wine glass, said device comprising:

a sleeve being comprised of a resiliently stretchable material wherein said sleeve is configured to be positioned a wine glass thereby enabling said sleeve to compress against the wine glass for retaining said sleeve around the wine glass;

a lid being pivotally disposed on said sleeve, said lid being biased into a closed position having said lid being positioned over said sleeve wherein said lid is configured to cover the wine glass when said sleeve is positioned around the wine glass to inhibit insects from entering the wine glass, said lid being urgeable into an open position having said lid being displaced laterally from said sleeve wherein said lid is configured to expose the wine glass thereby enabling the user to drink from the wine glass; and an opening mechanism being movably attached to said sleeve, said opening mechanism having a trigger wherein said trigger is configured to be manipulated by the user, said opening mechanism being in mechanical communication with said lid, said lid being urged into said open position when said trigger is depressed wherein said opening mechanism is configured to enable to the user to urge said lid into said open position to drink from the wine glass, said opening mechanism biasing said lid into said closed position when said trigger is not depressed wherein said opening mechanism is configured to automatically position said lid in said closed position for the user when the user releases said trigger;

wherein said sleeve having a bottom edge and a top edge and an outer wall extending between said top edge and said bottom edge;

wherein said sleeve has a channel being integrated into said outer wall;

wherein said channel extends from said top edge to a point located below said bottom edge;

wherein said channel has a rear facing wall being spaced from said outer wall of said sleeve to define a space in said channel; and wherein said top edge of said sleeve is oriented to lie on a plane which angles downwardly toward said bottom edge of said sleeve between an intersection with said channel and an opposite side of said top edge with respect to said channel wherein said top edge is configured to enable the user to drink from the wine glass without touching their lips to said sleeve.

2. The wine glass cover device according to claim 1, wherein:

said lid has a perimeter edge being continuously arcuate about a center of said lid such that said lid has a disk shape;

said lid has a tab extending laterally away from said perimeter edge;

said tab is positioned over said channel on said outer wall of said sleeve; and said lid has a hole extending through a top surface and a bottom surface of said lid wherein said hole is configured to pass air through said lid thereby enabling air to circulate in the wine glass when said lid is in said closed position, said hole being centrally located on said lid;

said device includes a strainer being disposed on said lid having said strainer covering said hole in said lid wherein said strainer is configured to inhibit insects from passing through said hole; and said strainer is foraminous wherein said strainer is configured to enable air to pass through said strainer.

3. A wine glass cover device for opening or closing a wine glass to either inhibit insects from entering the wine glass or to enable a user to drink from the wine glass, said device comprising:

a sleeve being comprised of a resiliently stretchable material wherein said sleeve is configured to be positioned a wine glass thereby enabling said sleeve to compress against the wine glass for retaining said sleeve around the wine glass;

a lid being pivotally disposed on said sleeve, said lid being biased into a closed position having said lid being positioned over said sleeve wherein said lid is configured to cover the wine glass when said sleeve is positioned around the wine glass to inhibit insects from entering the wine glass, said lid being urgeable into an open position having said lid being displaced laterally from said sleeve wherein said lid is configured to expose the wine glass thereby enabling the user to drink from the wine glass; and an opening mechanism being movably attached to said sleeve, said opening mechanism having a trigger wherein said trigger is configured to be manipulated by the user, said opening mechanism being in mechanical communication with said lid, said lid being urged into said open position when said trigger is depressed wherein said opening mechanism is configured to enable to the user to urge said lid into said open position to drink from the wine glass, said opening mechanism biasing said lid into said closed position when said trigger is not depressed wherein said opening mechanism is configured to automatically position said lid in said closed position for the user when the user releases said trigger;

wherein said sleeve has a top edge;

wherein said lid has a tab extending laterally away from a perimeter edge of said lid;

wherein said opening mechanism includes a shaft being located in said space in said channel;

wherein a top end of said shaft is affixed to said tab on said perimeter edge of said lid;

wherein a bottom end of said shaft is rotatably attached to a bottom wall of said channel;

wherein said shaft is biased to rotate in a first direction thereby enabling said lid to be positioned over said top edge of said sleeve; and wherein said shaft is rotatable in a second position having said lid being displaced from said top edge of said sleeve.

4. The wine glass cover device according to claim 3, wherein:

said opening mechanism includes a linkage comprising a first arm having a first end being pivotally coupled to a coupled end of a second arm;

said first arm has a second end being pivotally attached to a connection point on an outside surface of said shaft;

said connection point is located adjacent to said bottom end of said shaft;

said second arm being extendable outwardly through an opening in a rear facing wall of said channel;

said first arm is curved between said first end of said first arm and said second end of said first arm;

said connection point is rotated toward said outer wall of said sleeve when said shaft is biased to rotate in said first direction having said first arm curving around said shaft and having a distal end of said second arm being aligned with said rear facing wall of said channel; and said connection point is directed toward said rear facing wall of said channel when said shaft is rotated in said second direction having said first arm extending toward said rear facing wall of said channel and having said second arm extending outwardly through said opening in said rear facing wall of said channel.

5. The wine glass cover device according to claim 4, wherein:

said trigger comprises a first panel being oriented at an angle with a second panel;

an intersection between said first panel and said second panel is hingedly attached to said rear facing wall of said channel at an intersection with a bottom wall of said channel;

said second panel is curved between an intersection with said first panel and a lower edge of said second panel wherein said second panel is configured to accommodate the user's finger;

said distal end of said second arm of said linkage is pivotally attached to a front surface of said first panel;

said first panel rests against said rear facing wall of said channel when said shaft is biased to rotate in said first direction; and said first panel angles rearwardly from said rear facing wall of said channel when said second panel is depressed thereby enabling said linkage to rotate said shaft in said second direction.

6. A wine glass cover device for opening or closing a wine glass to either inhibit insects from entering the wine glass or to enable a user to drink from the wine glass, said device comprising:

a sleeve being comprised of a resiliently stretchable material wherein said sleeve is configured to be positioned a wine glass thereby enabling said sleeve to compress against the wine glass for retaining said sleeve around the wine glass, said sleeve having a bottom edge and a top edge and an outer wall extending between said top edge and said bottom edge, said sleeve having a channel being integrated into said outer wall, said channel extending from said top edge of said sleeve to a point located below said bottom edge of said sleeve, said channel having a rear facing wall being spaced from said outer wall of said sleeve to define a space in said channel, said top edge of said sleeve being oriented to lie on a plane which angles downwardly toward said bottom edge of said sleeve between an intersection with said channel and an opposite side of said top edge with respect to said channel wherein said top edge is configured to enable the user to drink from the wine glass without touching their lips to said sleeve;

a lid being pivotally disposed on said sleeve, said lid being biased into a closed position having said lid being positioned over said sleeve wherein said lid is configured to cover the wine glass when said sleeve is positioned around the wine glass to inhibit insects from entering the wine glass, said lid being urgeable into an open position having said lid being displaced laterally from said sleeve wherein said lid is configured to expose the wine glass thereby enabling the user to drink from the wine glass, said lid having a perimeter edge being continuously arcuate about a center of said lid such that said lid has a disk shape, said lid having a tab extending laterally away from said perimeter edge, said tab being positioned over said channel on said outer wall of said sleeve, said lid having a hole extending through a top surface and a bottom surface of said lid wherein said hole is configured to pass air through said lid thereby enabling air to circulate in the wine glass when said lid is in said closed position, said hole being centrally located on said lid;

a strainer being disposed on said lid having said strainer covering said hole in said lid wherein said strainer is configured to inhibit insects from passing through said hole, said strainer being foraminous wherein said strainer is configured to enable air to pass through said strainer; and an opening mechanism being movably attached to said sleeve, said opening mechanism having a trigger wherein said trigger is configured to be manipulated by the user, said opening mechanism being in mechanical communication with said lid, said lid being urged into said open position when said trigger is depressed wherein said opening mechanism is configured to enable to the user to urge said lid into said open position to drink from the wine glass, said opening mechanism biasing said lid into said closed position when said trigger is not depressed wherein said opening mechanism is configured to automatically position said lid in said closed position for the user when the user releases said trigger, said opening mechanism comprising:

a shaft being located in said space in said channel, a top end of said shaft being affixed to said tab on said perimeter edge of said lid, a bottom end of said shaft being rotatably attached to a bottom wall of said channel, said shaft being biased to rotate in a first direction thereby enabling said lid to be positioned over said top edge of said sleeve, said shaft being rotatable in a second position having said lid being displaced from said top edge of said sleeve; and a linkage comprising a first arm having a first end being pivotally coupled to a coupled end of a second arm, said first arm having a second end being pivotally attached to a connection point on an outside surface of said shaft, said connection point being located adjacent to said bottom end of said shaft, said second arm being extendable outwardly through an opening in said rear facing wall of said channel, said first arm being curved between said first end of said first arm and said second end of said first arm, said connection point being rotated toward said outer wall of said sleeve when said shaft is biased to rotate in said first direction having said first arm curving around said shaft and having a distal end of said second arm being aligned with said rear facing wall of said channel, said connection point being directed toward said rear facing wall of said channel when said shaft is rotated in said second direction having said first arm extending toward said rear facing wall of said channel and having said second arm extending outwardly through said opening in said rear facing wall of said channel; and wherein said trigger comprises a first panel being oriented at an angle with a second panel, an intersection between said first panel and said second panel being hingedly attached to said rear facing wall of said channel at an intersection with said bottom wall of said channel, said second panel being curved between an intersection with said first panel and a lower edge of said second panel wherein said second panel is configured to accommodate the user's finger, said distal end of said second arm of said linkage being pivotally attached to a front surface of said first panel, said first panel resting against said rear facing wall of said channel when said shaft is biased to rotate in said first direction, said first panel angling rearwardly from said rear facing wall of said channel when said second panel is depressed thereby enabling said linkage to rotate said shaft in said second direction.

* * * * *